US011125424B2

(12) United States Patent
Deakins

(10) Patent No.: US 11,125,424 B2
(45) Date of Patent: Sep. 21, 2021

(54) LUMINAIRE MOUNTING ASSEMBLY

(71) Applicant: ABL IP Holding LLC, Atlanta, GA (US)

(72) Inventor: Bryant James Deakins, Kansasville, WI (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/813,095

(22) Filed: Mar. 9, 2020

(65) Prior Publication Data

US 2020/0284412 A1 Sep. 10, 2020

Related U.S. Application Data

(60) Provisional application No. 62/815,526, filed on Mar. 8, 2019.

(51) Int. Cl.

| | |
|---|---|
| ***F21V 21/008*** | (2006.01) |
| ***F21S 8/06*** | (2006.01) |
| ***F21V 21/29*** | (2006.01) |
| ***F21V 23/00*** | (2015.01) |
| ***F21V 21/108*** | (2006.01) |

(52) U.S. Cl.

CPC ..... *F21V 21/29* (2013.01); *F21S 8/061* (2013.01); *F21V 21/008* (2013.01); *F21V 21/108* (2013.01); *F21V 23/002* (2013.01)

(58) Field of Classification Search

CPC ..... F21V 21/008; F21V 21/104; F21S 8/061
USPC ..... 362/147, 407
See application file for complete search history.

(56) References Cited

U.S. PATENT DOCUMENTS 3,512,743 A * 5/1970 Lipscomb ..... F21V 21/22 248/324
6,280,145 B1 * 8/2001 Liu ..... F04D 25/088 416/244 R

* cited by examiner

*Primary Examiner* — Sean P Gramling
(74) *Attorney, Agent, or Firm* — Kilpatrick Townsend & Stockton LLP

(57) ABSTRACT

A mounting system for suspending luminaires from a mounting surface with a cord. In some embodiments, the cord houses both the cable for supporting the luminaire in a suspended orientation as well as the electrical wires or connectors for electrically connecting the luminaire to a power source. In some embodiments, the mounting system is designed to ensure that the cable bears the entire weight of the luminaire and that the connectors bear no weight of the luminaire. The mounting system can include a pan that is mounted to the mounting surface and a rotatable joint positioned within the pan. The cord is attached to the rotatable joint. Rotation of the rotatable joint within the pan enables the cord to extend at nadir regardless of the angle of the mounting surface and without kinking of the cord.

17 Claims, 24 Drawing Sheets

LUMINAIRE MOUNTING ASSEMBLY

CROSS REFERENCE TO RELATED APPLICATIONS

This application claims the benefit of U.S. Prov. App. No. 62/815,526, titled "Pendant Luminaire Mounting Assembly" and filed on Mar. 8, 2019, which is incorporated herein in its entirety.

FIELD OF THE INVENTION

The present invention relates to mounting systems for installing suspended luminaires.

BACKGROUND

Luminaires can be hung so as to extend downwardly from a mounting surface, such as a ceiling or wall. The luminaires are typically hung using a cord or chain, separate from which (but in parallel with) run exposed wires for electrically connecting the luminaire to a power supply. Not only do the exposed wires detract from the appearance of the installation, they sometimes bear part of the weight of the luminaire, which can damage the wires and comprises operation of the luminaire. Moreover, sometimes luminaires are suspended from angled or sloped mounting surfaces such that they extend at an angle that is not perpendicular to the mounting surface. This can cause the chain or cord supporting the luminaire (as well as the wires) to kink. There is a need for a mounting system for suspended luminaires (such as pendant luminaires fixtures) that enables the luminaire to extend with a chain or cord from a mounting surface oriented at a variety of different angles without kinking. There is also a need for a mounting system that conceals the electrical wires from view and prevents the wires from bearing any weight of the luminaire.

SUMMARY

Certain embodiments provide a mounting system for suspending luminaires from a mounting surface with a cord. In some embodiments, the cord houses both the cable for supporting the luminaire in a suspended orientation as well as the electrical wires or connectors for electrically connecting the luminaire to a power source. In some embodiments, the mounting system is designed to ensure that the cable bears the entire weight of the luminaire and that the connectors bear no weight of the luminaire. The mounting system can include a pan that is mounted to the mounting surface and a rotatable joint positioned within the pan. The cord is attached to the rotatable joint. Rotation of the rotatable joint within the pan enables the cord to extend at nadir regardless of the angle of the mounting surface and without kinking of the cord.

These illustrative embodiments are mentioned not to limit or define the disclosure, but to provide examples to aid understanding thereof. Additional embodiments are discussed in the Detailed Description, and further description is provided there.

BRIEF DESCRIPTION OF THE DRAWINGS

Features, embodiments, and advantages of the present disclosure are better understood when the following Detailed Description is read with reference to the accompanying drawings, where.

DETAILED DESCRIPTION

The subject matter of features of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain features of the invention include a mounting assembly for a suspended luminaire, such as (but not limited to) a pendant luminaire. The mounting assembly can include a cord and a joint assembly. A luminaire having the mounting assembly according to aspects of the present disclosure can hang from a mounting surface without kinking of the cord. Rather, regardless of the angle of the mounting surface from which the luminaire extends, the joint assembly enables the cord to adjust so as to extend vertically downwardly (i.e., at nadir). If the luminaire is a pendant luminaire, the cord will extend substantially coaxially with the center of the pendant luminaire (e.g. the center of mass). In this way, the luminaire can hang substantially straight down from the mounting surface even when the mounting surface is uneven, angled, sloped, pitched, or slanted and without bending or kinking the cord.

The cord of the mounting assembly may include a jacket (e.g. an insulated jacket) that at least partially surrounds a cable and any number of electrical wires or conductors that provide an electrical connection to the luminaire. The cable within the cord may bear some or the full weight of the luminaire. The conductors may provide the electrical connection without bearing the weight of the luminaire. The cord may bear the full weight of the luminaire such that no additional cables, chains, or other weight bearing elements need to be coupled to the luminaire to support it from the mounting surface. Thus, the luminaire may be installed using a single cord that both supports the full weight of the luminaire and provides electrical conductors, which may provide for a clean and aesthetically pleasing look. For example, the luminaire does not need to be secured to a mounting surface via a chain that is hung co-axially and visibly separate from a cord comprising the electrical conductors.

Figure 1:
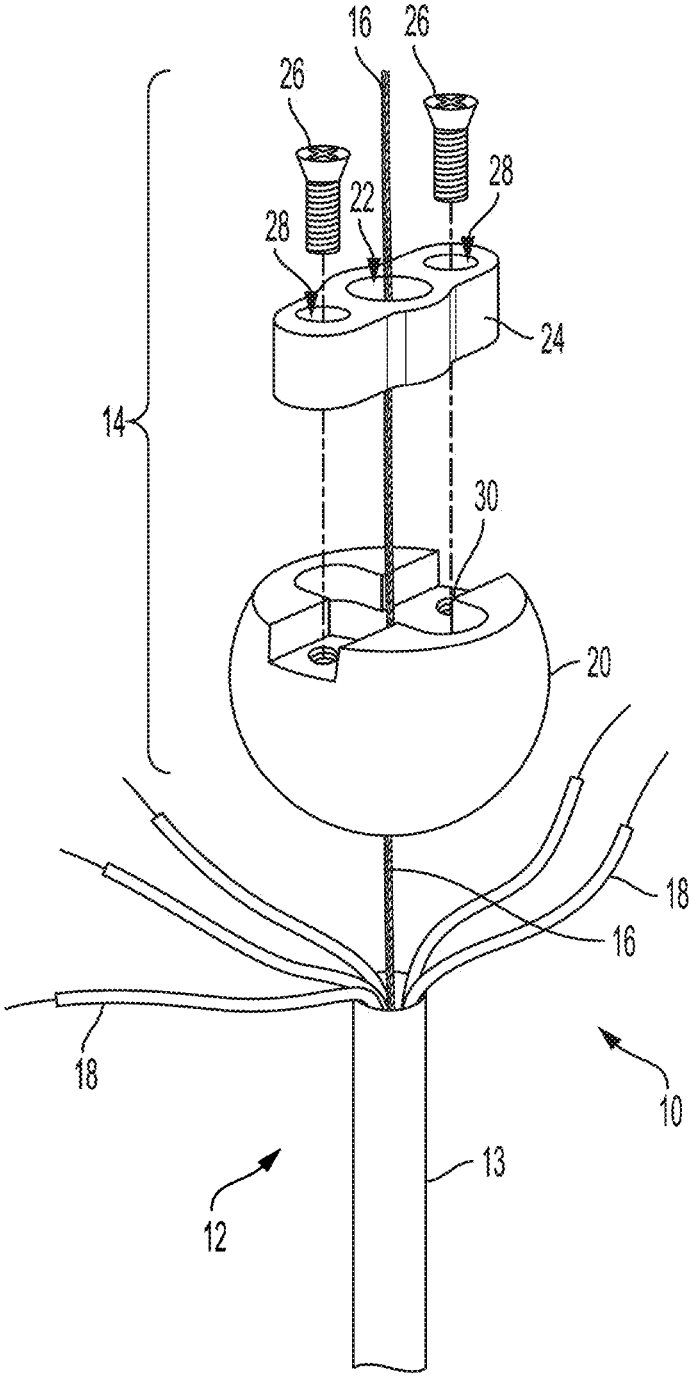
FIG. 1 depicts an exploded view of an example of a mounting assembly for use with a luminaire, the mounting assembly including a cord and a joint assembly, according to the present disclosure.

FIG. 1 depicts an exploded view of a non-limiting embodiment of a mounting assembly 10 for a luminaire according to aspects of the present disclosure. The mounting assembly 10 includes a cord 12 and a joint assembly 14. The cord 12 may include a jacket 13 (e.g. an insulated jacket) that surrounds a cable 16 and at least one conductor 18 (e.g., 2, 4, 6, or 8 conductors). The cable 16 may be a weight bearing cable for supporting the luminaire. For example, the cable 16 may be an aircraft cable, a chain, or other suitable weight bearing element for supporting the weight of the luminaire.

The joint assembly 14 includes a rotatable joint 20 and a bracket 24. The rotatable joint 20 may be a sphere, or other suitable shape that may rotate or move in a mounting pan for the luminaire. FIG. 20A-20D illustrate various views of an embodiment of a rotatable joint 20 in isolation. The joint 20 is substantially spherical in shape and includes a top 21, a bottom 23, and an outer surface 25. At least one groove 37 extends along the outer surface 25 of the joint 20 between the top 21 and the bottom 23. An aperture 27 extends through the joint 20 from the top 21 to the bottom 23. A recessed ledge 29 is formed in the top 21 of the joint 20. As described in more detail below, the rotatable joint 20 is designed to seat and rotate within a pan in response to the natural hanging position of the luminaire as a result of gravity.

Figure 21:
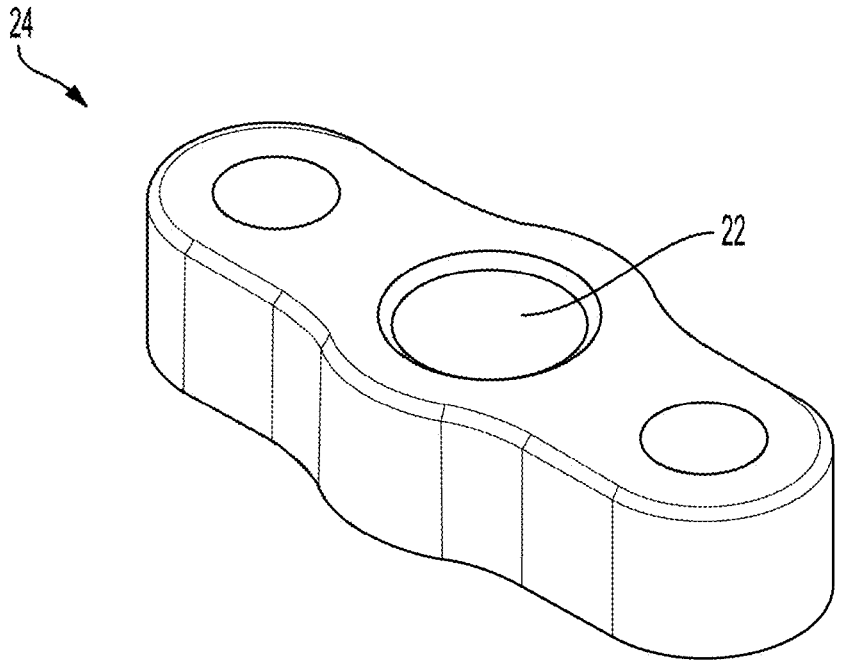
FIG. 21 is a perspective view of a bracket for use in mounting assemblies contemplated herein.

FIG. 21 illustrates an embodiment of a bracket 24. The bracket includes a central aperture 22. The bracket 24 is sized and shaped to seat on the recessed ledge 29 of the joint 20.

In use, the cord 12 extends into the aperture 27 of the joint 20. The end of the cord 12 is stripped to expose the cable 16 and conductors 18. Cable 16 passes through the central aperture 22 of the bracket 24 of the joint assembly 14. The conductors 18 may also pass through the rotatable joint 20 but may bypass the aperture 22 in the bracket 24 (see FIG. 2). In other words, the conductors 18 may pass around the bracket 24. The bracket 24 may be secured to the rotatable joint 20 via fasteners 26 that extend through the bracket 24 and into screw apertures 30 in the rotatable joint 20.

Figure 2:
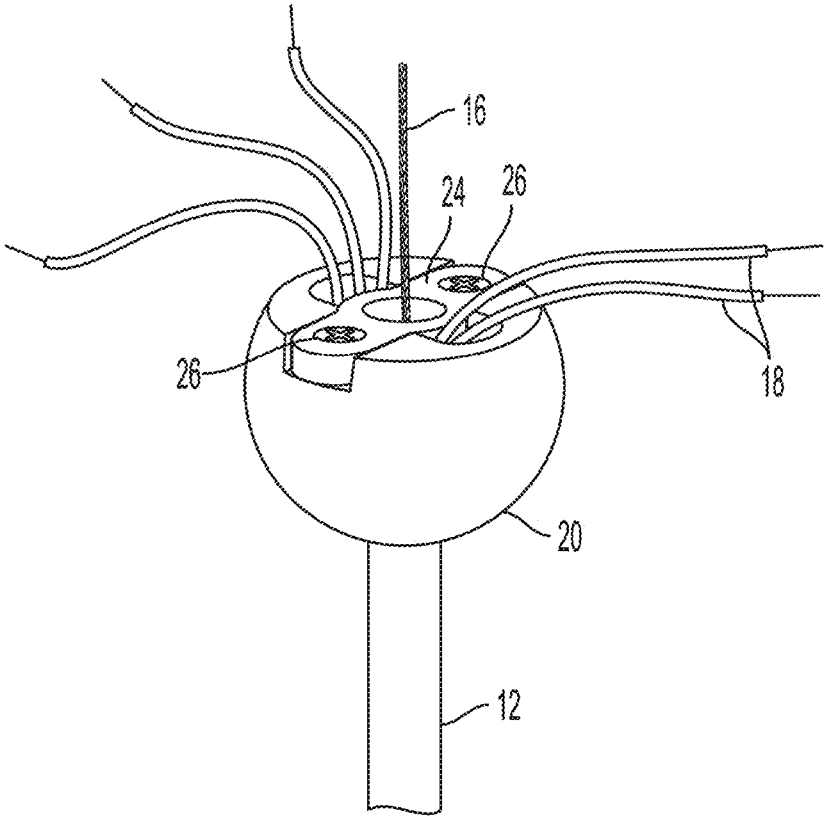
FIG. 2 depicts an example of the joint assembly of FIG. 1 including a bracket attached to a rotatable joint, according to the present disclosure.

FIG. 2 depicts a non-limiting example of the mounting assembly 10 of FIG. 1 with the bracket 24 coupled to the rotatable joint 20. As shown in FIGS. 1 and 2, the bracket 24 may be sized and shaped to seat on the recessed ledge 29 of the rotatable joint 20. As shown in FIG. 2, the cable 16 passes through the apertures 27, 22 of the rotatable joint 20 and the bracket 24, respectively. The conductors 18 pass through the rotatable joint 20 and extend around the bracket 24 such that the weight of the luminaire is not transferred to the conductors 18.

The cable 16 may be coupled to the bracket 24 such that motion of the cable 16 relative to the bracket 24 is limited or prevented. In some aspects, the cable 16 is coupled to the bracket 24 by positioning a stop on an end of the cable 16 above the bracket 24 (e.g., tying a knot or attaching a nut) to prevent the end of the cable from passing through the central aperture 22 in the bracket 24.

Figure 3:
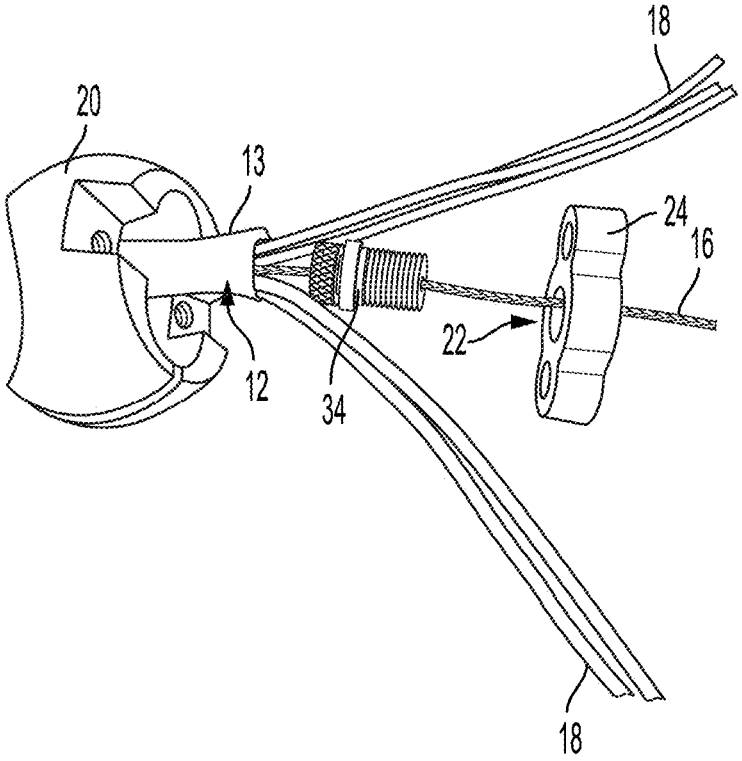
FIG. 3 depicts the joint assembly of FIG. 2 with the cord passing through the rotatable joint and the bracket having a securing nut separate from the bracket, according to the present disclosure.
Figure 4:
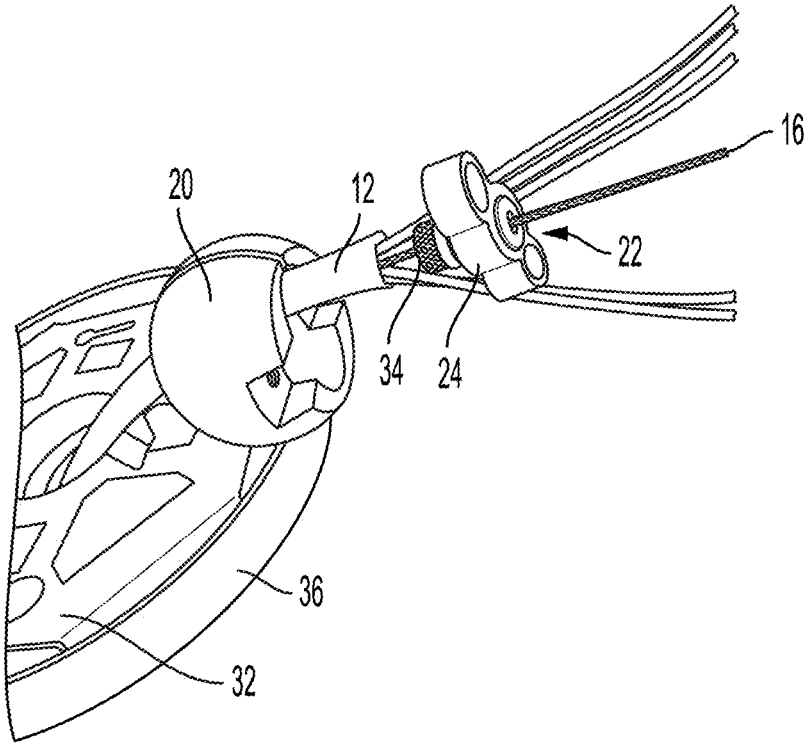
FIG. 4 depicts the joint assembly of FIG. 2 with the cord passing through the rotatable joint and the securing nut coupled with the bracket, according to the present disclosure.

In other aspects, for example as shown in the non-limiting embodiment of FIGS. 3-4, the cable 16 may be secured in place relative to the bracket 24 by a securing nut 34. The securing nut 34 may be positioned between the rotatable joint 20 and the bracket 24; however, in other embodiments the securing nut 34 may be positioned on an opposing side of the bracket 24 from the rotatable joint 20. FIG. 3 further depicts the jacket 13 of the cord 12 passing through the rotatable joint 20. The jacket 13 is stripped away to reveal the conductors 18 and the cable 16. The cable 16 extends through the aperture 22 in the bracket 24 and the conductors 18 pass around the bracket 24. In FIG. 3, the securing nut 34 is depicted uncoupled from the bracket 24.

As shown in FIG. 4, the cable 16 may pass through an opening in the securing nut 34 and may be fixedly coupled to the securing nut 34 such that the cable 16 cannot move relative to the securing nut 34, for example by a nut (or grip lock) or other feature of the securing nut 34 that tightens against the cable 16 to lock against the cable 16.

Figure 22:
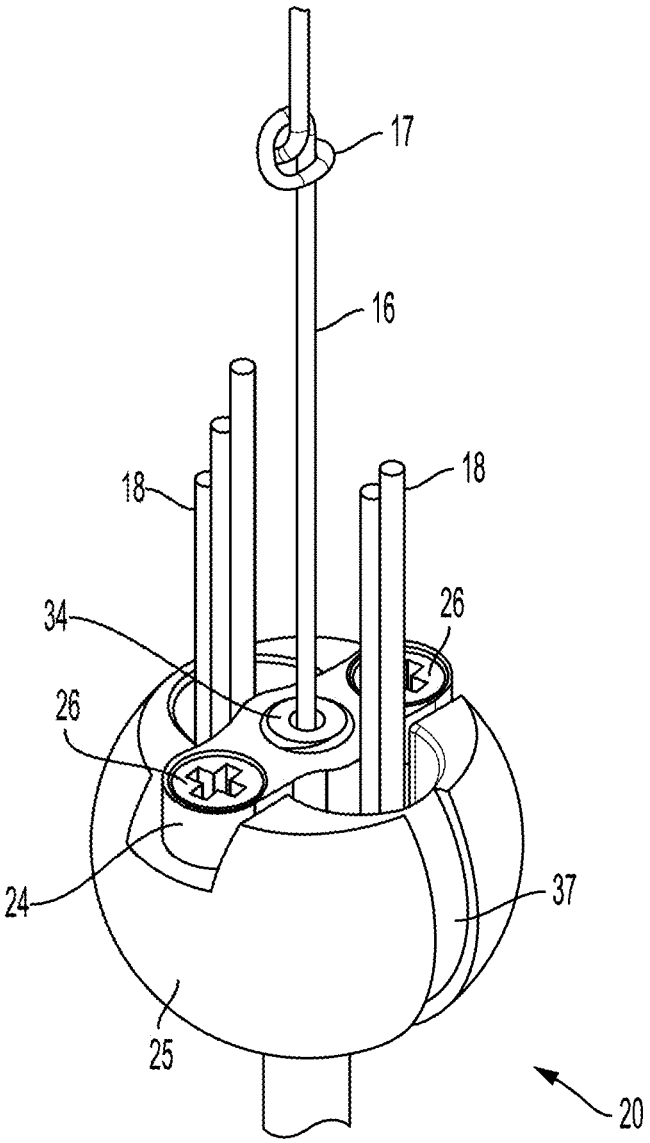
FIG. 22 depicts the joint assembly of FIG. 2 with an knot in the cable.

A portion of the securing nut 34 may be sized and shaped to fixedly couple to the bracket 24, for example by snap fit engagement, magnetic engagement, or other suitable means. In some embodiments, the securing nut 34 can be a threaded fastener that can screw into the aperture 22 in the bracket 24 to secure the cable 16 to the bracket 24 such that the cable 16 does not move relative to the bracket 24, for example in the non-limiting embodiment shown in FIGS. 3-4. In some embodiments, other suitable means may be used to couple the cable 16 to the bracket 24 such that motion of the cable 16 relative to the bracket 24 is limited or prevented, for example but not limited to by knotting an end of the cable 16 such that it cannot disengage from the bracket 24 (see FIG. 22).

Figure 5A:
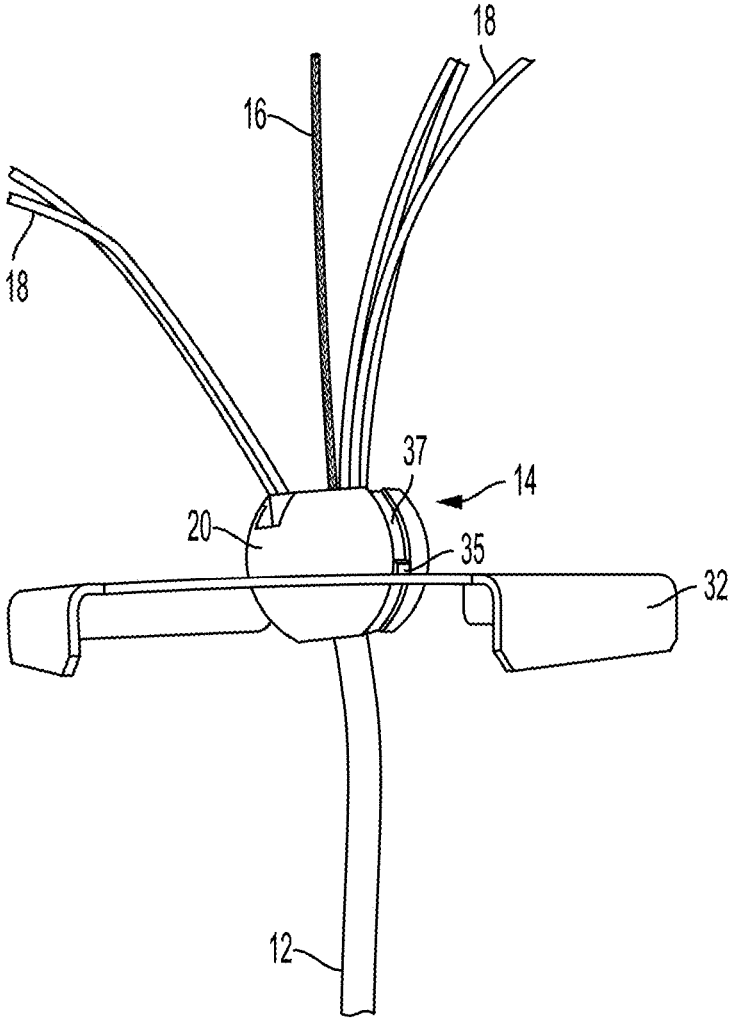
FIGS. 5A and 5B depict an example of the mounting assembly of FIG. 1 including the cord, joint assembly, and a pan, according to various embodiments.
Figure 5B:
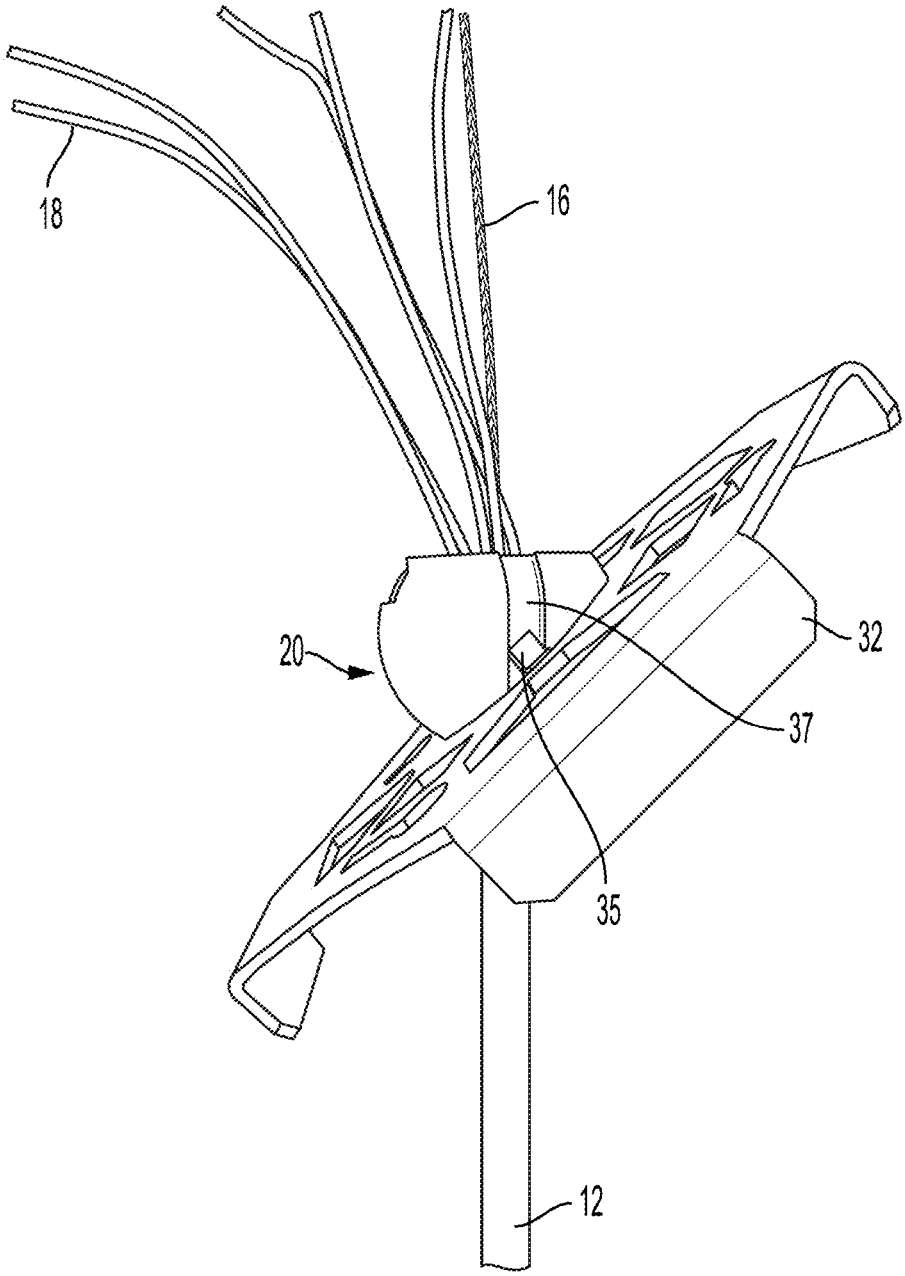

In a non-limiting embodiment shown in FIGS. 5A and 5B, the joint assembly 14 (with the bracket 24 (not visible in FIGS. 5A-5B) coupled to the rotatable joint 20) may be coupled to a pan 32 of the luminaire. In use, the pan 32 is typically secured to the mounting surface to attach the luminaire to the mounting surface. The rotatable joint 20 may seat within an opening in a pan 32 and rotate relative to the pan 32, for example by rotating from side to side within the opening in the pan 32, as shown in FIGS. 5A-5B. In some embodiments, the rotatable joint 20 is positioned within the pan 32 such that a tab 35 extending from the pan 32 is received in the groove 37 of the rotatable joint 20. In some embodiments additional tabs and grooves may be included. The tab 35 may move along a length of the groove 37 to permit the rotatable joint 20 to rotate about a first axis within the pan opening when the rotatable joint 20 is received in the pan 32 (see FIG. 5A). The tab 35 may move parallel to the groove 37 along the length of the groove 37. However, the width of the groove 37 and the size of the tab 35 may be such that the tab 35 may also rotate laterally about a second axis within the groove 37. For example, in the arrangement of FIGS. 5A-5B the tab 35 is small enough and positioned in relation to the groove 37 to permit the rotatable joint 20 to rotate about the second axis, which may be perpendicular to the first axis (see FIG. 5B). For example the tab 35 may be offset within the groove so that it no longer aligns with the axis of the groove (see FIG. 5B). In the arrangement of FIGS. 5A-5B, the engagement of the tab 35 in the groove 37 may prevent the rotatable joint 20 from rotating significantly about a vertical axis (an axis along the cord 12), which can twist and kink the wires. However, in other embodiments, the rotatable joint 20 may be free to rotate in about a vertical axis as well. Thus, the rotatable joint 20 may be rotated in a variety of directions relative to the pan 32.

The pan 32 may be coupled to an inner region of a canopy 36 of the luminaire (FIG. 6), which imparts a polished appearance to the installation at the mounting surface. In some embodiments, the pan 32 may be secured to the mounting surface with the tab 35 disposed perpendicular to a strike line of the mounting surface (e.g., a horizontal line within the plane of the mounting surface), so that the rotatable joint 20 can rotate sufficiently to permit the cord 12 to extend vertically downward.

Figure 6:
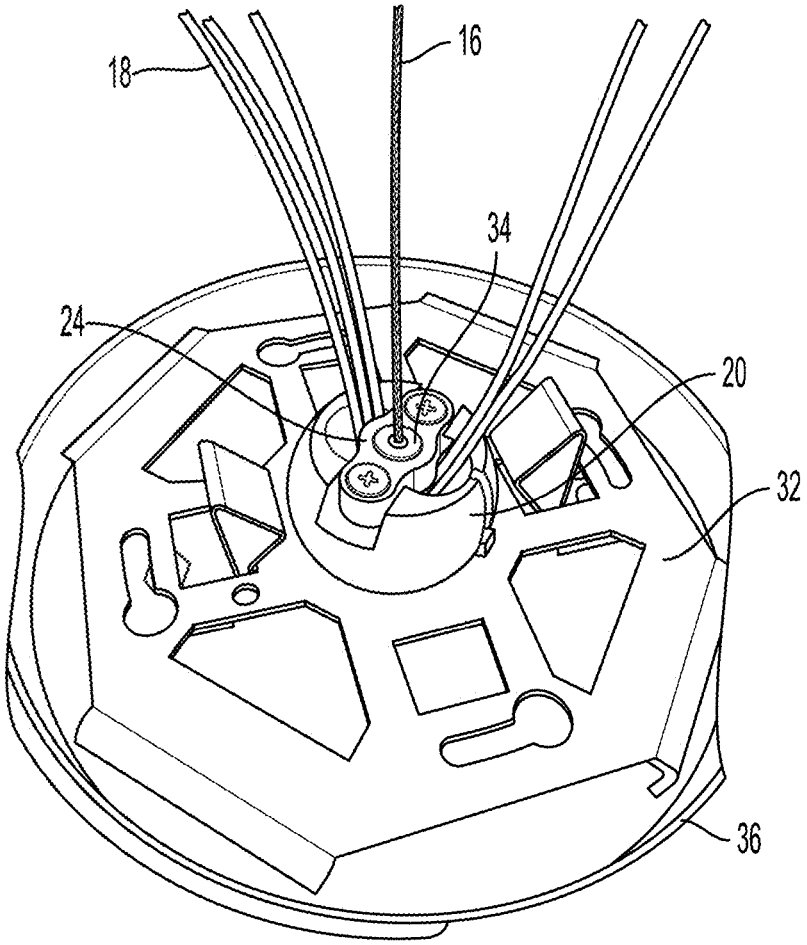
FIG. 6 depicts an example of the mounting assembly of FIGS. 5A and 5B including a canopy, according to various embodiments.
Figure 7:
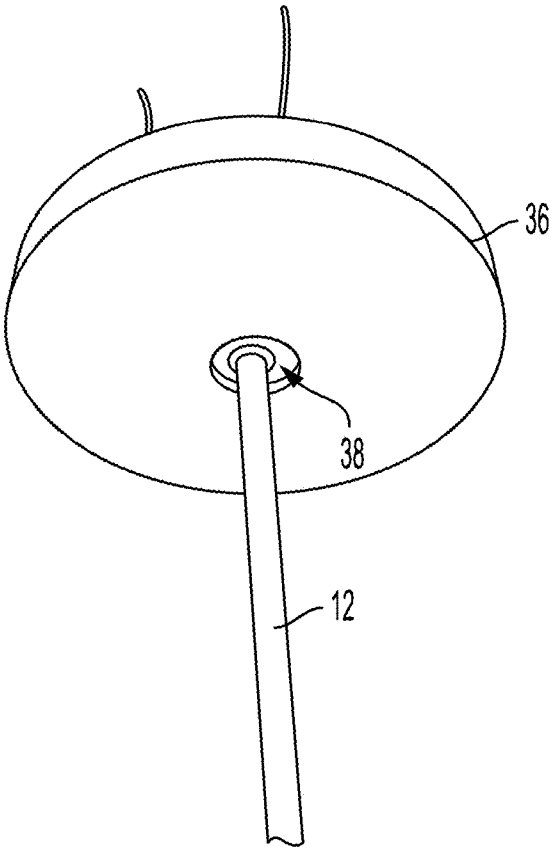
FIG. 7 depicts an example of the underside of the mounting assembly of FIG. 6 including the cord extending from an opening in the canopy, according to various embodiments.

FIG. 7 depicts a view of the canopy 36 with the cord 12 extending from the canopy 36 through a canopy opening 38 and towards the luminaire (not shown in FIG. 7). The pan 32 is positioned on the inner region of the canopy 36 that is not visible in FIG. 7. With reference to FIGS. 6 and 7, the rotatable joint 20 may rotate in the pan 32 in response to the gravitational pull of the luminaire such that the cord 12 is always oriented at nadir. For example, the rotatable joint 20 may rotate within the pan opening such that the cord 12 coupled to the joint 20 may extend coaxially with a pendant luminaire, thus preventing kinking of the cord 12 as it extends from the rotatable joint 20, bottom 23, and canopy 36 to the pendant luminaire. Kinking of the cord 12 can damage the cable 16 and the conductors 18, and can be aesthetically undesirable. The canopy opening 38 may be shaped to prevent kinking of the cord 12 as it passes through the canopy 36. The canopy opening 38 may be circular, oval, rectangular, or otherwise shaped to provide a range of hanging positions of the cord 12 without kinking the cord 12. The size, shape, and orientation of the canopy opening 38 may aid in permitting the cord 12 to hang straight from the mounting surface to the pendant luminaire without kinking the cord 12.

Figure 8:
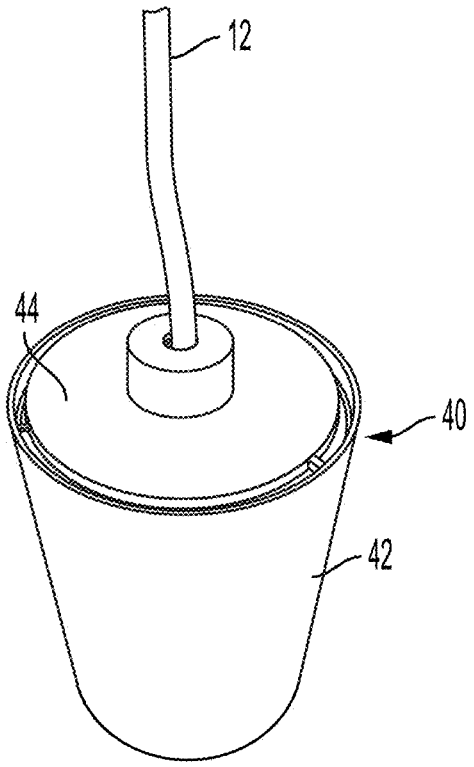
FIG. 8 depicts an example of a pendant luminaire for use with the mounting assembly of FIG. 1, according to various embodiments.

In a non-limiting embodiment depicted in FIG. 8, the cord 12 extends from the canopy 36 (not shown) down to a pendant luminaire 40. Note that the luminaire need not be a pendant luminaire and/or need not be the particular pendant luminaire described here. Rather, the mounting systems disclosed herein may be applicable to many different types of suspended luminaires. As shown in FIGS. 12-15, the pendant luminaire 40 may include a housing 42 that supports one or more light sources (not shown), a mounting plate 43, a cover plate 44, and a finish nut 45 to seal the area where the cord 12 enters the luminaire 40 and impart a polished appearance to the luminaire 40. In the illustrated embodiment, the mounting plate 43 is secured to the luminaire housing 42 (such as with screws 47) and the cover plate 44 is positioned over the mounting plate 43 and secured to the luminaire 40 via the finish nut 45 that engages a threaded post 49 on the mounting plate 43.

Figure 9:
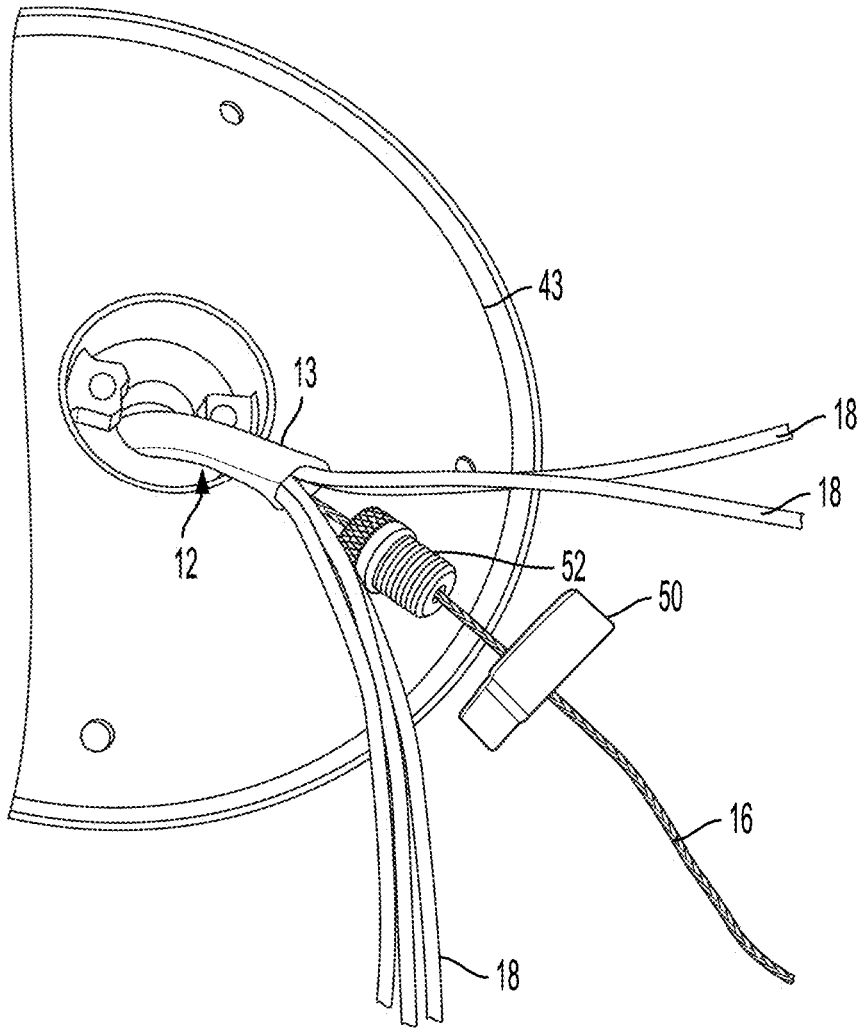
FIGS. 9 through 11 depict attachment of the cord to the pendant luminaire of FIG. 8 with an embodiment of the mounting assembly contemplated herein, according to various embodiments.
Figure 10:
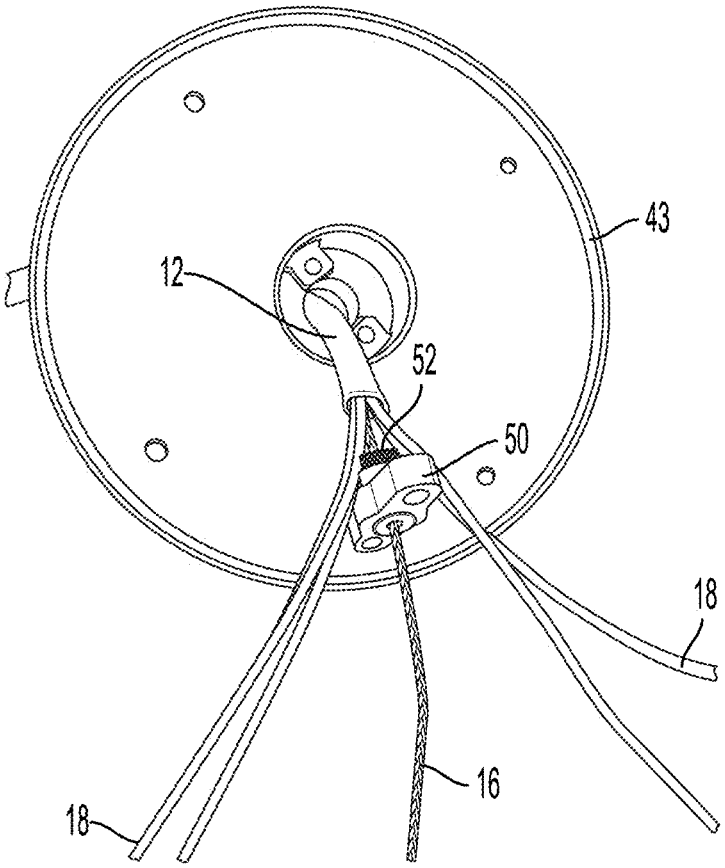

The cord 12 extends through apertures in the finish nut 45, the cover plate 44, and the mounting plate 43 and is fixedly connected to the luminaire 40. The jacket 13 of the cord 12 is stripped away to provide access to the cable 16 and the conductors 18 and permit their separation from each other. An end of the cable 16 (not shown in FIG. 8) is secured to the pendant luminaire 40 to support the weight of the pendant luminaire 40. More specifically, the end of the cable 16 is connected to the mounting plate 43 via a bracket 50. FIG. 9 depicts an underside of the mounting plate 43. The cable 16 may pass through an opening 48 in a bracket 50. The cable 16 may be secured to the bracket 50 by a securing nut 52. The cable 16 may pass through an opening in the securing nut 52 and may be fixedly coupled to the securing nut 52 for example by a nut or other feature of the securing nut 52 that fixes the cable 16 to the securing nut 52 such that the cable 16 cannot move relative to the securing nut 52. The cable 16 may not move relative to the bracket 50 when the securing nut 52 is coupled to the bracket 50 (such as via threaded engagement), as shown in FIG. 10. The bracket 50 and securing nut 52 may be the same type or a different type of bracket and securing nut as the bracket 24 and securing nut 34 that couples the cable 16 at an opposite end to the rotatable joint 20. The securing nut 52 may include a threaded region that mates with threads in the opening 48 of the bracket 50. Other means of securing the cable 16 to the bracket 50 may be used, for example by knotting the cable 16 such that it cannot pass through the opening 48 of the bracket 50.

Figure 11:
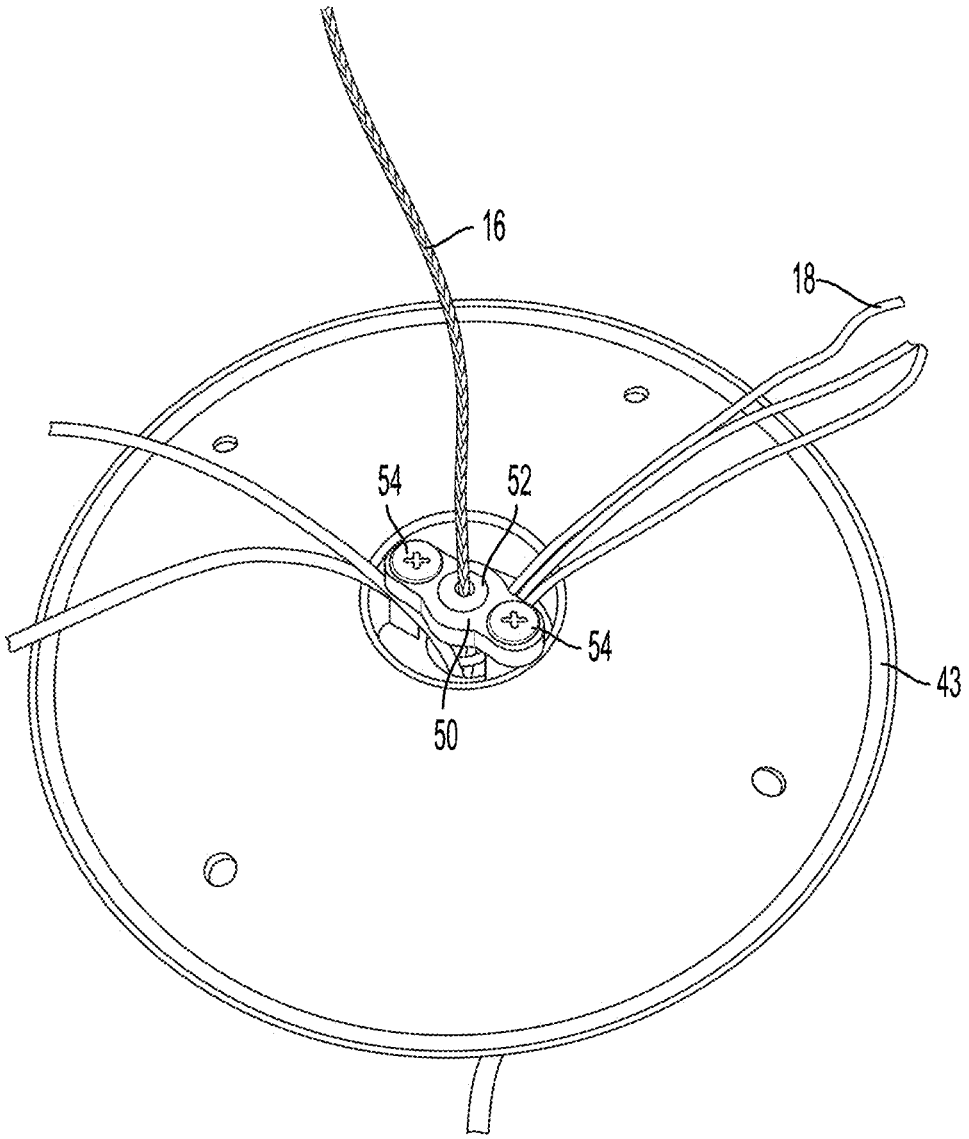
Figure 12:
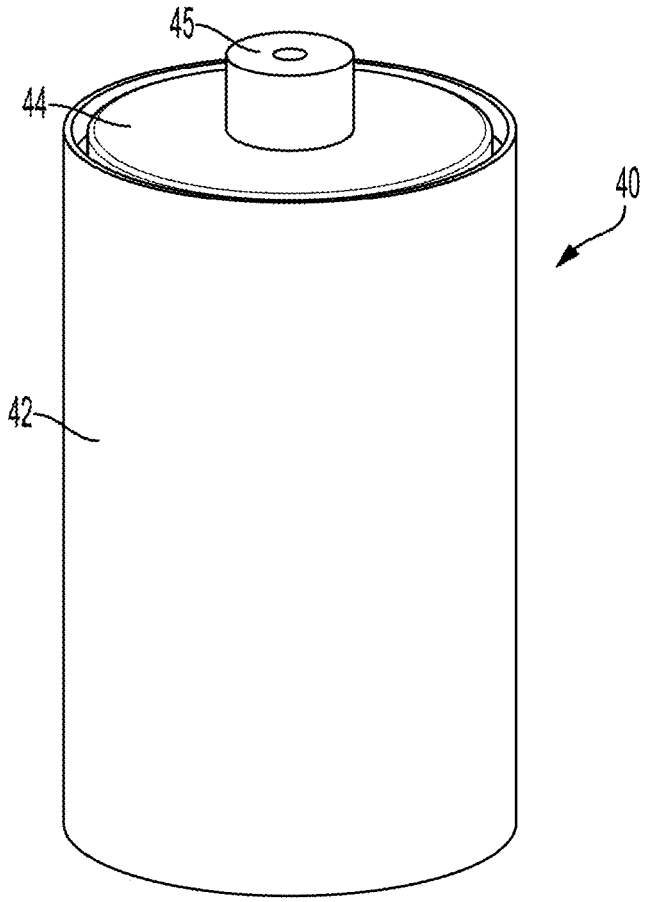
FIG. 12 depicts the pendant luminaire of FIG. 8 in isolation.
Figure 13:
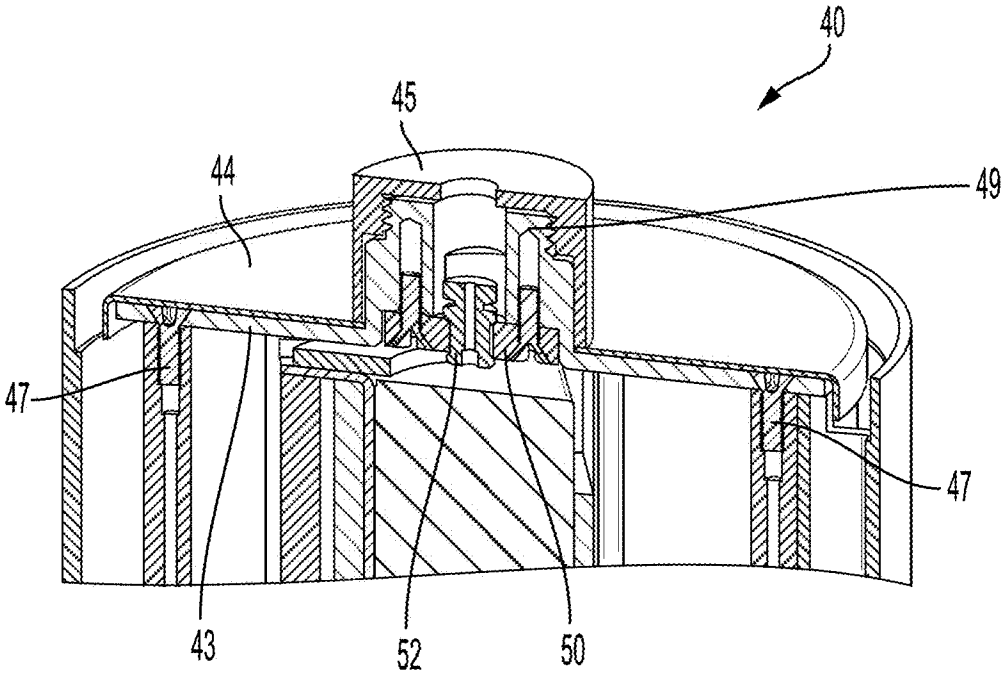
FIG. 13 depicts a partial cross-section of the pendant luminaire of FIG. 12.
Figure 14:
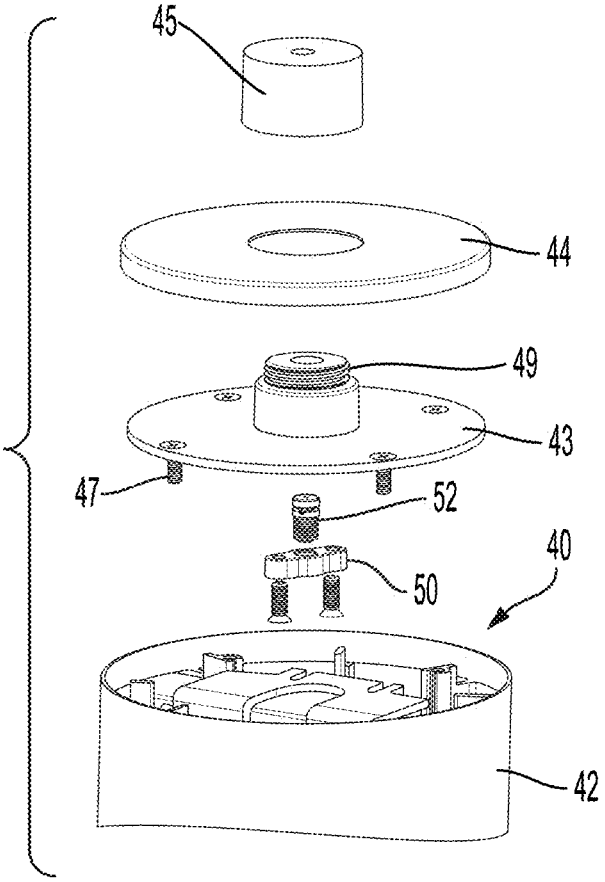
FIG. 14 depicts an exploded view of the pendant luminaire of FIG. 12.
Figure 15:
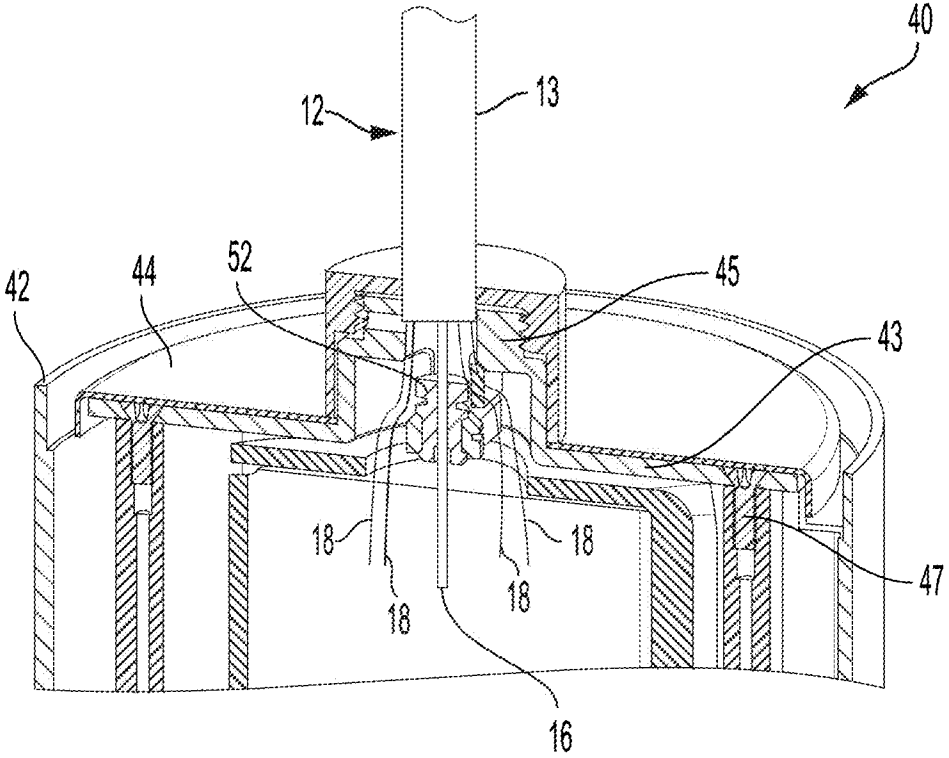
FIG. 15 depicts a partial cross-section of the pendant luminaire of FIG. 12 and a cord.

As shown in FIG. 11, in one non-limiting embodiment, the bracket 50 (with associated securing nut 52) may be mounted to the underside of the mounting plate 43, such as via one or more fasteners 54 (e.g. screws). In some embodiments, the bracket 50 may be secured to the mounting plate 43 by other means, including but not limited to by other mechanical features, magnetic features, or adhesive features. For example, the bracket 50 may be snap fit into the mounting plate 43, may be threaded together with the mounting plate 43, may be glued or otherwise adhesively adhered to the mounting plate 43, or may be secured to the mounting plate 43 via magnetic attraction.

Thus, one end of the cable 16 is secured to the pendant luminaire and an opposing end of the cable 16 is secured to the rotatable joint 20. In some embodiments, the cable 16 may be secured to other features of the mounting assembly 10 instead of or in addition to the mounting plate 43 of the pendant luminaire 40 and the rotatable joint 20. The cable 16 can support the full weight of the pendant luminaire 40 such that the weight of the pendant luminaire 40 is not transferred to the conductors 18.

As shown in FIGS. 7-8, only the cord 12 is visible between the mounting surface and the pendant luminaire 40. Thus, no separate cable, cord, chain, or other support means is required beyond the cord 12. Having only cord 12 extending from the mounting surface to the pendant luminaire 40 may be aesthetically pleasing to a purchaser, as compared to mounting assemblies in which a weight bearing cable and a separate cord containing conductors may extend from the mounting surface to the luminaire. In addition and as described above, the cord 12 may extend straight down at nadir from the mounting surface to the pendant luminaire 40, regardless of the angle of the mounting surface, without kinking of the cord 12. Regardless of the angle of the mounting surface, the rotatable joint 20 may rotate and come to rest in a position in which the cord 12 extends straight down such that it is coaxially aligned with the center of the pendant luminaire 40.

The length of the cable 16 extending between the rotatable joint 20 and the pendant luminaire may define the position of the pendant luminaire 40 relative to the mounting surface. The length of the cable 16 (and thus the distance of the luminaire 40 from the mounting surface) may be adjusted by changing the position of one or both of securing nuts 34, 52 or of brackets 24, 50 along the length of the cable 16.

Figure 16:
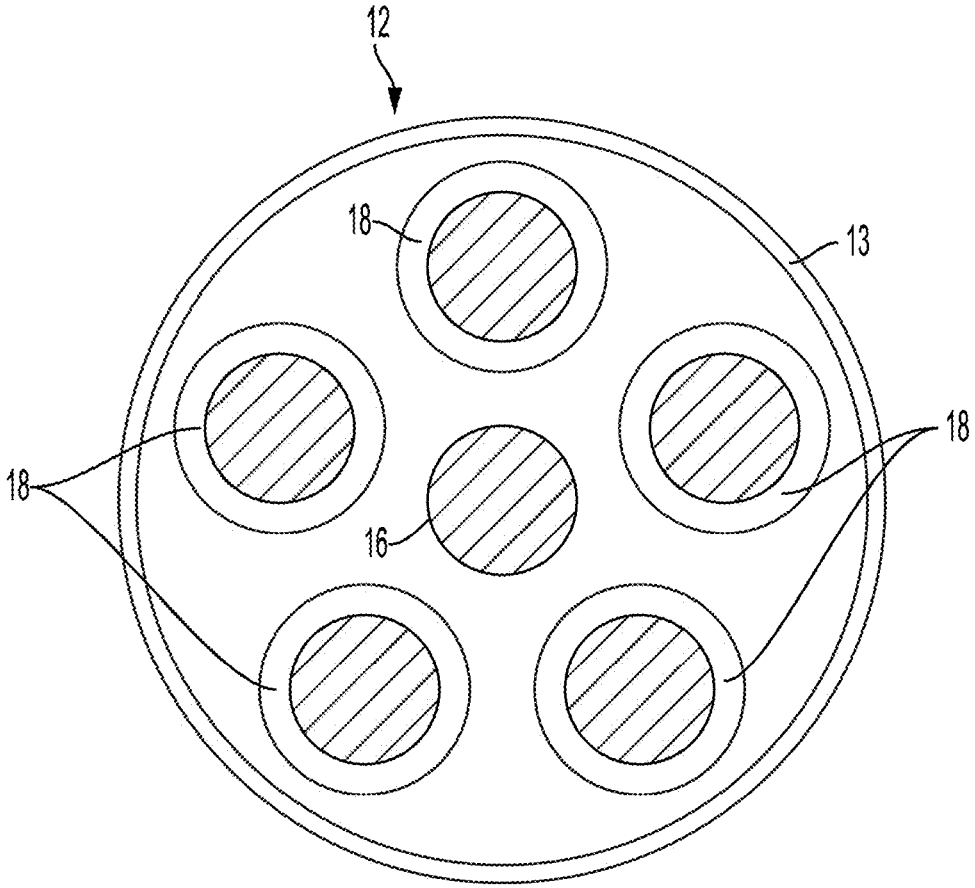
FIG. 16 depicts a cross-section of an example cord for use with the mounting assemblies contemplated herein.

One illustrated, non-limiting embodiment of a cross-sectional view of a cord of the present disclosure, for example but not limited to cord 12, is shown in FIG. 16. The jacket 13 of the cord 12 surrounds the cable 16 and the plurality of conductors 18. While the jacket 13 may be filled, such as with an insulative material, such that the cable 16 and conductors 18 are isolated, in other embodiments the cable 16 and conductors 18 contact each other within the jacket 13. In the non-limiting embodiment of FIG. 16, five conductors 18 are shown, though in other embodiments more or fewer conductors 18 may be included. For example, 2 conductors, 4 conductors, 6 conductor, 8 conductors, or another desirable number of conductors may be included in the cord 12. The conductors 18 may be wires (e.g., copper wires) surrounded by one or more insulation materials. In some embodiments the cable 16 may be a chain or other element for bearing the weight of the pendant luminaire 40. In some embodiments, the cord 12 may be manufactured with the cable 16 and the conductors 18 positioned within the jacket 13, such that a weight bearing cable need not be inserted in a cord comprising only conductors. In some embodiments, the cord 12 may comprise only conductors 18 and a cable may be threaded into the cord 12 post-manufacturing of the cord 12, before installing the pendant luminaire.

Figure 17:
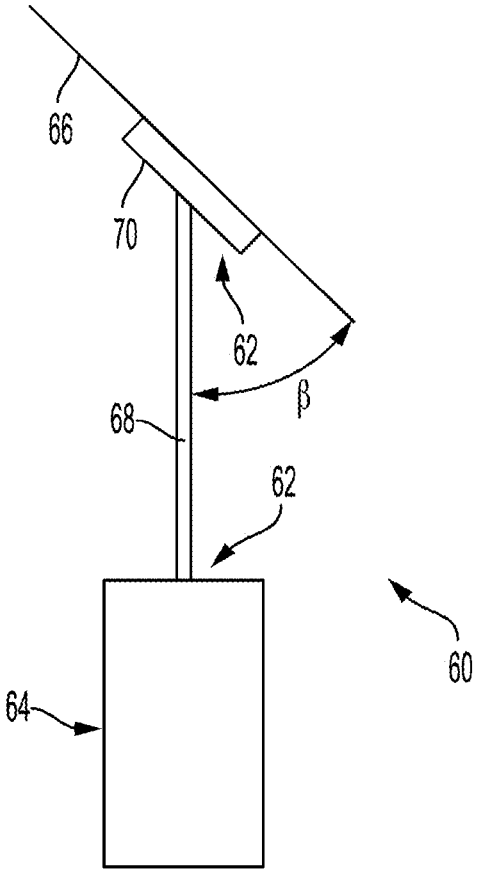
FIGS. 17-19 depict a luminaire suspended from an angled mounting surface using embodiments of the mounting assemblies contemplated herein.

One illustrated, non-limiting embodiment of a pendant luminaire 60 that includes a luminaire housing 64 and a mounting assembly 62 is shown in FIG. 17. The luminaire housing 64 is suspended from an angled or sloped mounting surface 66. Despite this and as shown in FIG. 17, the mounting assembly 62 permits the cord 68 to extend from the canopy 70 (which extends at the same slope or angle as the mounting surface 66) vertically down at nadir. The cord 68 does not kink or bend as it extends from the canopy 70 to the luminaire housing 64, such that the cord is coaxial with a center-point of the luminaire housing 64 (e.g. the center of mass of the luminaire housing 64). The cord 68 can extend at any angle β relative to the surface of the mounting surface 66.

Figure 18:
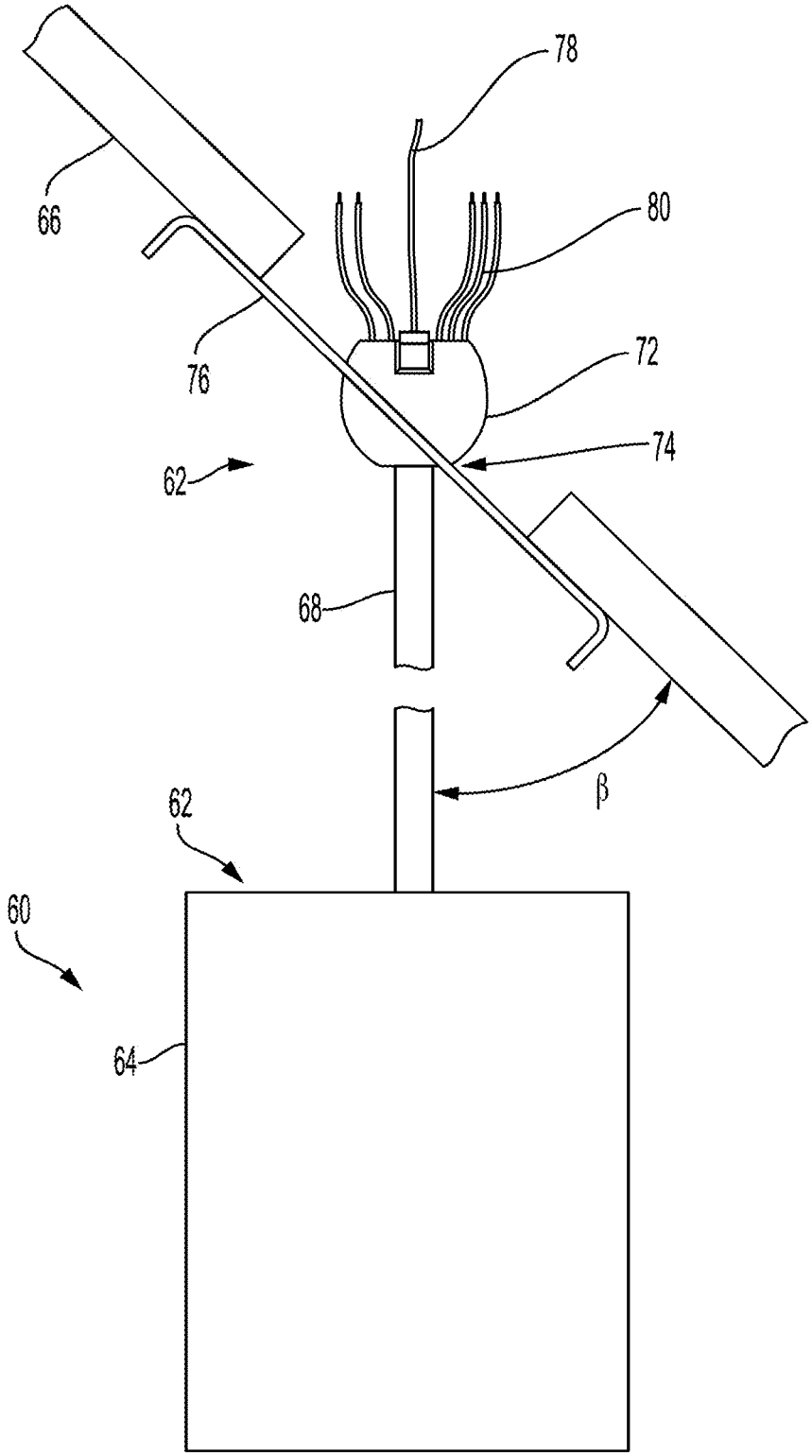
Figure 19:
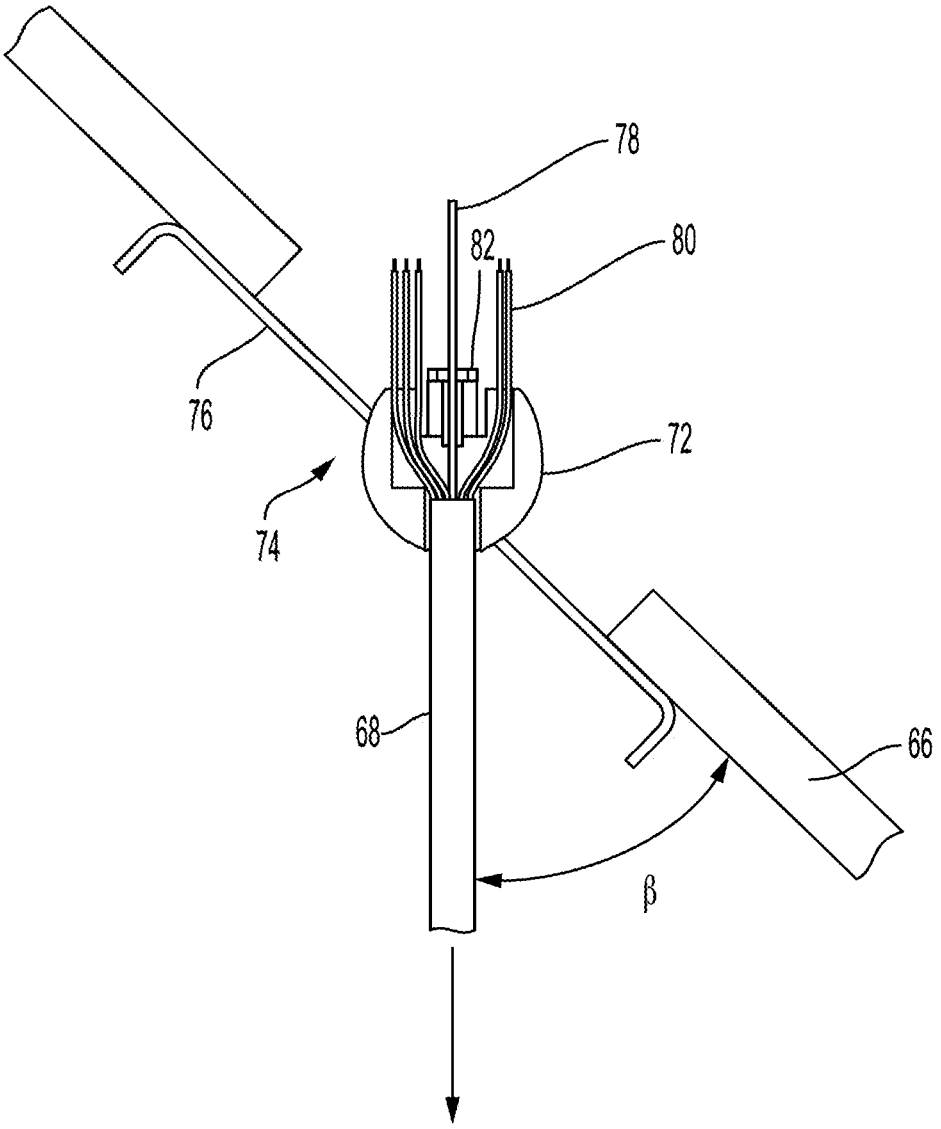
Figure 20A:
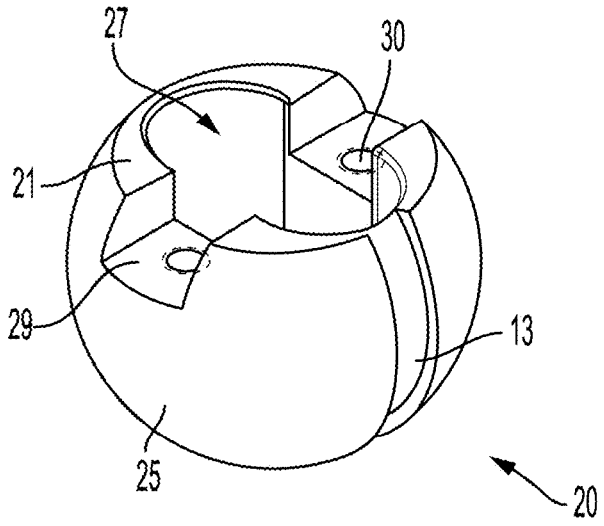
FIGS. 20A-20D depict various views of an embodiment of a rotatable joint for use in mounting assemblies contemplated herein.
Figure 20B:
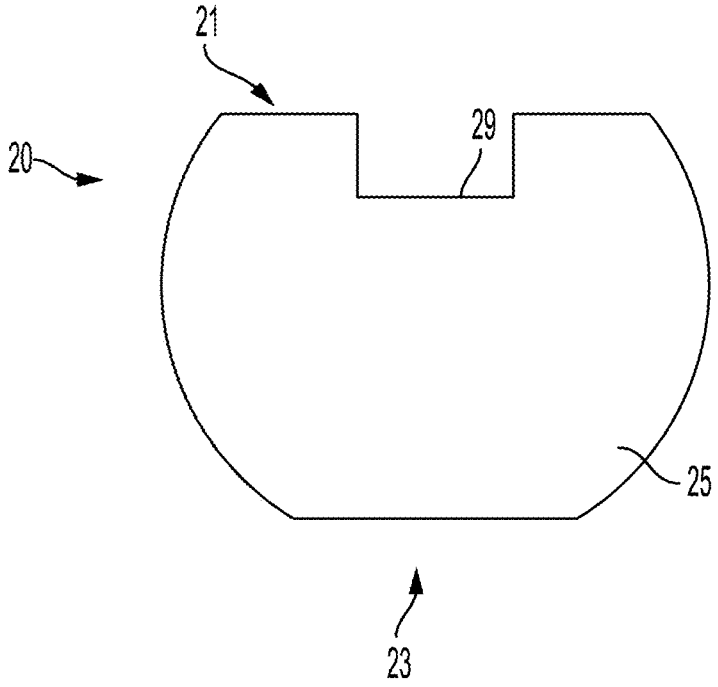
Figure 20C:
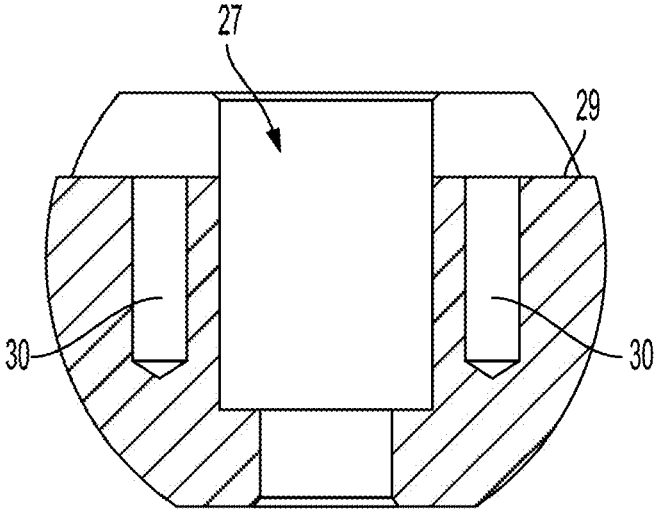
Figure 20D:
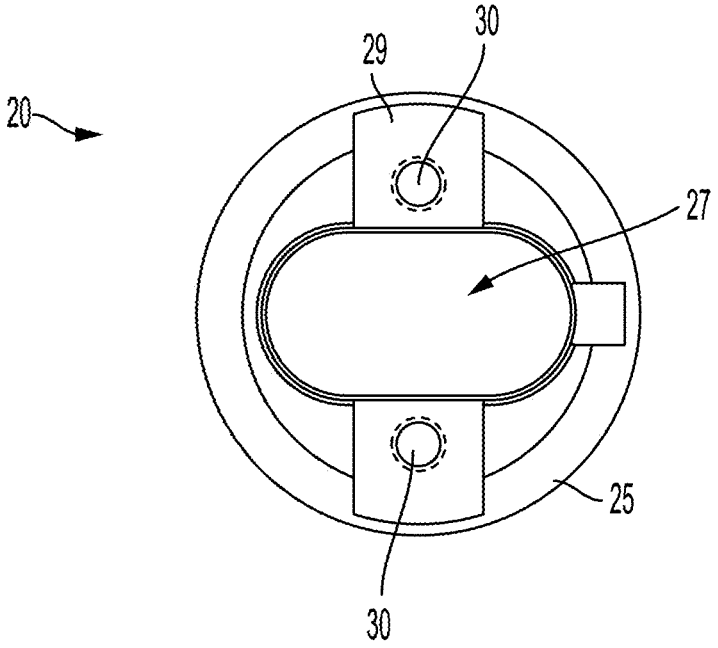

One illustrated, non-limiting embodiment of the mounting assembly 62 is also shown in FIGS. 18 and 19. The canopy 70 is not shown in FIG. 18 to provide a better view of the other elements of the mounting assembly 62. As shown in FIG. 18, the cord 68 hangs straight down at nadir from a rotatable joint 72, shown in FIG. 18 as a swivel ball or sphere. The rotatable joint 72 sits within an opening 74 in a pan 76. The pan 76 may be coupled to the mounting surface 66 for mounting or installing the pendant luminaire 60. The rotatable joint 72 may rotate within the opening 74 until the cord 68 passing through the rotatable joint 72 hangs straight down to the luminaire housing 64 without kinking or bending.

The rotatable joint 72 may rotate to various positions within the opening 74 of the pan 76 depending upon factors, including but not limited to the angle of the mounting surface or surface upon which the pan 76 is mounted. Within the rotatable joint 72, a cable 78 (for example but not limited to an aircraft cable) may be exposed from within a jacket of the cord 68 and may be fixedly coupled to the rotatable joint 72, for example as described in various non-limiting embodiments discussed above. Conductors 80 may also be exposed from within the jacket of the cord 68 for coupling to a power source for powering the luminaire. The conductors 80 may not bear any weight of the luminaire housing 64.

FIG. 19 depicts a portion of FIG. 18 in cross-section, in particular depicting a cross-sectional view of the rotatable joint 72. As shown in the non-limiting embodiment of the rotatable joint 72 and pan 76 depicted in FIG. 19, the cord 68 may enter the rotatable joint 72. The cable 78 may be exposed from the jacket of the cord 68 and may be coupled to the rotatable joint 72, for example but not limited to via a fastener assembly 82 such that the cable 78 may not move relative to the rotatable joint 72. In other words, the rotatable joint 72 may not move linearly along a length of the cable 78 once fastened. The fastener assembly 82 may include a bracket and a fastener. The conductors 80 may not pass through the fastener assembly 82 but rather may extend around the fastener. The rotatable joint 72 may rotate within the opening 74 of the pan 76 so as to permit the positioning of the cord 68 directly above the housing (not shown) of the pendant luminaire, without bending or kinking the cord 68. The position of the rotatable joint 72 may be manually adjusted in some aspects. In some aspects, the rotatable joint 72 may automatically come to rest in a position in which the cord 68, including for example the cable 78 and conductors 80, is not bent or kinked between the mounting surface 66 and the housing 64 of the pendant luminaire 60. For example, the gravitational force on the housing 64 may cause the rotatable joint 72 to come to rest in a position in which the cord 68 is coaxial with a center-point of the luminaire housing 64. If friction between the rotatable joint 72 and the pan 76 prevents the rotatable joint from naturally reaching a position in which the cord is oriented at nadir by gravity alone, the rotatable joint 72 may be manually adjusted by an installer by simply pushing or pulling the cord 68 sideways as needed to further rotate the rotatable joint 72. In some embodiments, the pan 76 may be coated or lined with a low-friction material where the pan 76 is contacted by the rotatable joint 72. In addition, as shown in FIGS. 17-19 only cord 68 may be visible passing from the mounting surface 66 to the housing 64 of the pendant luminaire 60.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

What is claimed is:

1. A luminaire assembly adapted to be suspended from a mounting surface, the luminaire assembly comprising:

a. a luminaire comprising a weight;

b. a mounting assembly comprising:

i. a pan adapted to be mounted on the mounting surface, wherein the pan defines a pan opening and comprises a tab;

ii. a joint comprising a top, a bottom separated a distance from the top, and an outer surface defining a groove that extends along the outer surface at least a portion of the distance between the top and the bottom so as to define a groove length extending along a groove axis, wherein the joint is adapted to be positioned within the pan opening such that the tab of the pan is received within the groove of the joint, wherein the tab is sized and shaped such that the tab (i) can move longitudinally within and along the groove parallel to the groove axis to permit the joint to rotate about a first axis and (ii) can rotate laterally within the groove transverse to the groove axis to permit the joint to rotate about a second axis, and wherein the joint defines an aperture that extends through the joint from the top to the bottom; and iii. a cord having a first end and an opposing second end, wherein:

(a) the cord is adapted to extend between the mounting surface and the luminaire; and (b) the cord comprises a jacket at least partially surrounding a support cable and one or more electrical wires, wherein the support cable at the first end of the cord is adapted to extend through the aperture of the joint and to fixedly couple to the joint and wherein the support cable at the second end of the cord is adapted to fixedly couple to the luminaire such that the support cable is adapted to bear the weight of the luminaire when the luminaire is suspended from the mounting surface.

2. The luminaire assembly of claim 1, wherein the mounting assembly further comprises a securing bracket adapted to couple to the joint.

3. The luminaire assembly of claim 2, wherein the top of the joint defines a recessed ledge and wherein the securing bracket is sized and shaped to seat on the recessed ledge.

4. The luminaire assembly of claim 2, wherein the mounting assembly further comprises a securing nut defining an opening therethrough, wherein the support cable at the first end of the cord is adapted to engage the opening of the securing nut such that the securing nut cannot move relative to the support cable.

5. The luminaire assembly of claim 4, wherein the securing nut is adapted to couple with the securing bracket such that the support cable at the first end of the cord is fixedly attached to the securing bracket.

6. The luminaire assembly of claim 2, wherein the support cable extends at least partially through an aperture defined in the securing bracket and wherein the one or more electrical wires extend through the aperture defined in the joint but bypass the aperture defined in the securing bracket.

7. The luminaire assembly of claim 1, wherein the joint comprises a substantially semi-spherical portion adapted to be positioned within the pan opening.

8. The luminaire assembly of claim 1, wherein the luminaire further comprises a mounting plate and wherein the mounting assembly further comprises a securing bracket adapted to couple to the mounting plate of the luminaire.

9. The luminaire assembly of claim 8, wherein the mounting assembly further comprises a securing nut defining an opening therethrough and wherein the support cable at the second end of the cord is adapted to engage the opening of the securing nut such that the securing nut cannot move relative to the support cable.

10. The luminaire assembly of claim 9, wherein the securing nut is adapted to couple with the securing bracket such that the support cable at the second end of the cord is fixedly attached to the securing bracket.

11. The luminaire assembly of claim 1, wherein the mounting assembly is adapted to ensure that, when the mounting assembly suspends the luminaire from the mounting surface, the cord extends at nadir regardless of the angle at which the mounting surface extends.

12. The luminaire assembly of claim 1, wherein the joint is adapted to rotate within the pan opening in response to a gravitational pull on the luminaire when the luminaire is suspended from the mounting surface with the mounting assembly.

13. A mounting assembly for suspending a luminaire from a mounting surface, the mounting assembly comprising:

a pan defining a pan aperture and having a tab extending into the pan aperture;

a rotatable joint having a groove extending along an exterior surface of the rotatable joint, wherein the rotatable joint is positioned in the pan aperture and the tab is sized and shaped to be positioned within the groove and to allow the joint to rotate about a first axis when the tab travels along the length of the groove and about a second axis when the tab rotates laterally within the groove and wherein the rotatable joint defines a channel that extends through the rotatable joint; and a cord adapted to extend at least partially through the rotatable joint, wherein the cord comprises a jacket at least partially surrounding a support cable and one or more electrical wires and wherein the support cable is adapted to couple to the rotatable joint and to the luminaire, wherein, when the mounting assembly suspends the luminaire from the mounting surface, the rotatable joint is configured to rotate such that the cord extends at nadir regardless of the angle of the mounting surface and wherein the support cable is configured to support at least a portion of a weight of the luminaire.

14. The mounting assembly of claim 13, wherein the rotatable joint rotates in response to a gravitational pull on the suspended luminaire.

15. The mounting assembly of claim 14, wherein a low-friction material is provided at an interface between the pan and the rotatable joint and is configured to reduce resistance of the rotation of the rotatable joint relative to the pan aperture.

16. The mounting assembly of claim 13, wherein the mounting assembly further comprises a securing bracket coupled to the rotatable joint.

17. The mounting assembly of claim 16, wherein the rotatable joint comprises a top that defines a recessed ledge and wherein the securing bracket is sized and shaped to seat on the recessed ledge.

* * * * *